US011383397B2

(12) United States Patent
Park et al.

(10) Patent No.: US 11,383,397 B2
(45) Date of Patent: Jul. 12, 2022

(54) RAZOR ASSEMBLY

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 118 days.

(21) Appl. No.: 16/710,467

(22) Filed: Dec. 11, 2019

(65) Prior Publication Data

US 2020/0180178 A1 Jun. 11, 2020

(30) Foreign Application Priority Data

Dec. 11, 2018 (KR) ..... 10-2018-0158794

(51) Int. Cl.
*B26B 21/52* (2006.01)
*B26B 21/40* (2006.01)
(Continued)

(52) U.S. Cl.
CPC ..... *B26B 21/521* (2013.01); *B26B 21/4031* (2013.01); *B26B 21/02* (2013.01);
(Continued)

(58) Field of Classification Search
None
See application file for complete search history.

(56) References Cited

U.S. PATENT DOCUMENTS 5,687,485 A 11/1997 Shurtleff et al.
5,761,814 A 6/1998 Anderson et al.
(Continued)

FOREIGN PATENT DOCUMENTS

KR 1020060122880 11/2006
KR 1020120115259 10/2012
(Continued)

OTHER PUBLICATIONS

Korean Intellectual Property Office Application No. 10-2018-0158794, Final Office Action dated Aug. 3, 2020, 4 pages.
(Continued)

*Primary Examiner* — Hwei-Siu C Payer
(74) *Attorney, Agent, or Firm* — Lee, Hong, Degerman, Kang & Waimey PC

(57) ABSTRACT

A razor assembly includes a razor cartridge, a connector and a recovering force provider. The razor cartridge includes at least one shaving blade having a cutting edge, and a blade housing configured to receive the at least one shaving blade in a transverse direction. The connector is configured to extend in parallel with the transverse direction, and to be coupled to the blade housing so as to be pivotable around a pivot axis movable between a first rest position and a first position spaced apart from the first rest position in a first shaving direction. The recovering force provider includes a first recovering member configured to provide the connector with a recovering force for recovering the pivot axis to the first rest position when the pivot axis is located between the first rest position and the first position.

12 Claims, 13 Drawing Sheets

(51) Int. Cl.
*B26B 21/02* (2006.01)
*B26B 21/22* (2006.01)
*B26B 21/44* (2006.01)

(52) U.S. Cl.
CPC ..... *B26B 21/225* (2013.01); *B26B 21/4018* (2013.01); *B26B 21/443* (2013.01)

(56) References Cited

U.S. PATENT DOCUMENTS 5,956,848 A 9/1999 Tseng et al.
5,956,851 A 9/1999 Apprille et al.
6,041,926 A 3/2000 Petricca et al.
6,052,903 A 4/2000 Metcalf et al.
6,161,288 A * 12/2000 Andrews ..... B26B 21/00 30/50
6,185,822 B1 2/2001 Tseng et al.
6,212,777 B1 4/2001 Gilder et al.
6,442,839 B1 9/2002 Tseng et al.
6,516,518 B1 2/2003 Garraway et al.
6,612,040 B2 9/2003 Gilder
6,684,513 B1 2/2004 Clipstone et al.
7,086,160 B2 * 8/2006 Coffin ..... B26B 21/4006 30/532
7,331,107 B2 2/2008 Follo et al.
7,913,393 B2 * 3/2011 Royle ..... B26B 21/225 30/50
9,193,077 B2 11/2015 Worrick
9,283,685 B2 * 3/2016 Griffin ..... B26B 21/225
9,475,202 B2 * 10/2016 Griffin ..... B26B 21/4081
9,486,930 B2 * 11/2016 Provost ..... B26B 21/14
10,112,313 B2 * 10/2018 Robertson ..... B26B 21/52
10,391,654 B2 * 8/2019 Griffin ..... B29C 44/42
10,507,588 B2 * 12/2019 Provost ..... B26B 21/225
10,744,661 B2 * 8/2020 Griffin ..... B26B 21/4081
2004/0181954 A1 9/2004 Follo et al.
2005/0198843 A1 9/2005 Royle
2012/0124840 A1 * 5/2012 Iaccarino ..... B26B 21/225 30/50
2012/0210586 A1 8/2012 Lelieveld et al.
2012/0260509 A1 10/2012 Fang et al.
2013/0291391 A1 11/2013 Stevens
2015/0158192 A1 * 6/2015 Tucker ..... B26B 21/4068 83/13
2017/0217035 A1 8/2017 Treu et al.
2020/0180178 A1 * 6/2020 Park ..... B26B 21/4031

FOREIGN PATENT DOCUMENTS

WO 2005053917 6/2005
WO 2011058487 5/2011

OTHER PUBLICATIONS

European Patent Office Application Serial No. 19215204.9, Search Report dated Feb. 27, 2020, 7 pages.

* cited by examiner

RAZOR ASSEMBLY

CROSS-REFERENCE TO RELATED APPLICATIONS

Pursuant to 35 U.S.C. § 119(a), this application claims the benefit of earlier filing date and right of priority to Korean Patent Application Number 10-2018-0158794, filed on Dec. 11, 2018, the contents of which are hereby incorporated by reference herein in its entirety.

TECHNICAL FIELD

The present disclosure in some embodiments relates to a razor assembly.

BACKGROUND

The statements in this section merely provide background information related to the present disclosure and do not necessarily constitute prior art.

Generally, a razor cartridge is configured to be pivotable about a razor handle between a neutral position and a pivot position. The pivoting movement of the razor cartridge is basically centered about a rotation axis (hereinafter 'pivot axis') parallel to the alignment direction of shaving blades.

Pivot movement about the pivot axis helps to do an efficient shaving by allowing the shaving blades to be in smooth contact with the cutting surface, e.g. the user's skin. This pivot axis is usually fixed at a specific position in a blade housing.

However, a conventional wet razor with the pivot axis fixed may need to bear a large load at its blade housing during shaving when a sharp bend occurs on the skin contacting surface or when the hair to be cut is relatively thick.

This load may be wholly delivered to the user's skin, along with the force that the user transmits through the razor handle and the friction generated between the blade housing and the skin contacting surface.

As a result, an excessive force may be applied to the user's skin, thereby causing a safety issue in which the user's skin is damaged on the surface or cut before the user realizes that the blade housing is overloaded.

On the other hand, the conventional one-way wet razor has its pivot axis typically located adjacent to a guard portion. By positioning a pivot axis close to the guard portion on the blade housing, a high load would be applied to the guard portion, thereby enhancing the skin stretching function of the guard.

This arrangement of the pivot axis also maintains a good contact between the blade housing and the skin contacting surface by generating a natural rotational moment on the blade housing during shaving of curved surfaces.

On the other hand, a two-way wet razor features a cap and a guard with their positions switched according to the shaving direction and thus, it is commonly configured to have symmetrical formations of the blade housing and the shaving blade.

This makes it difficult for conventional two-way wet razors to position the pivot axis to a specific area of the blade housing, and it is common to place the pivot axis on the symmetry axis of the blade housing and the shaving blade.

As a result, such a conventional one-way wet razor has the fixed pivot axis suffering from a load generated due to unevenness of the skin or frictional force incurring a scratch or scar on the skin, and a two-way wet razor involves such pivot axis arranged in a way to reduce the function of the blade housing as a guard and to work against maintaining a good skin contact, impeding a smooth shaving experience.

U.S. Pat. No. 7,331,107 (hereinafter referred to as "patent document 1") and U.S. Pat. No. 9,193,077 ("patent document 2"), which relate to conventional wet razors, disclose providing a user with convenient handling through a pivot movement of the razor handle.

However, the razors disclosed by patent document 1 and patent document 2 make a handle pivot about a fixed pivot axis. When shaving, the razor handle is constantly rotated about the pivot axis, thus concentrating the force on the razor cartridge at a point where the pivot axis is formed. When an unevenness or protrusion surface occurs due to the skin condition of the user, the skin is subjected to a greater load by the force concentrated on the fixed pivot axis.

In addition, the disclosed razors have their razor handle and razor cartridge connected at different sites, which disadvantageously limits the angle between the two components at each site.

In particular, the razors disclosed by patent documents 1 and 2 are incapable of pivoting at each site where their razor handle and razor cartridge are connected, thereby failing to provide a smoother handling to the user.

SUMMARY

In accordance with one embodiment, the present disclosure provides a razor assembly including a razor cartridge, a connector and a recovering force provider. The razor cartridge includes at least one shaving blade having a cutting edge, and a blade housing configured to receive the at least one shaving blade in a transverse direction. The connector is configured to extend in parallel with the transverse direction, and to be coupled to the blade housing so as to be pivotable around a pivot axis movable between a first rest position and a first position spaced apart from the first rest position in a first shaving direction. The recovering force provider includes a first recovering member configured to provide the connector with a recovering force for recovering the pivot axis to the first rest position when the pivot axis is located between the first rest position and the first position.

DETAILED DESCRIPTION

Figure 1:
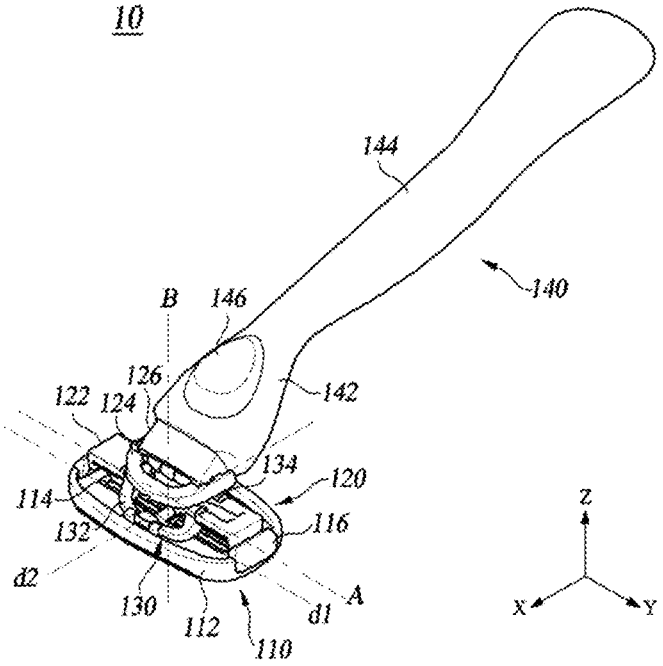
FIG. 1 is a perspective view of a razor assembly according to one embodiment of the present disclosure.

The present disclosure is primarily aimed at providing proper handling of a razor to the user during shaving by appropriately moving the pivot axis.

In addition, the present disclosure is primarily aimed at providing a safe shave to the user by appropriately moving the pivot axis according to the degree of load on the blade housing of a razor.

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

In describing the components of the embodiments according to the present disclosure, various terms such as first, second, i), ii), a), b), etc., may be used solely for the purpose of differentiating one component from the other, not to imply or suggest the substances, the order or sequence of the components. Throughout this specification, when a part "includes" or "comprises" a component, the part is meant to further include other components, not to exclude thereof unless specifically stated to the contrary.

In this specification, the first shaving direction refers to the direction in which shaving is performed using a conventional one-way wet razor and the second shaving direction refers to the opposite direction. Taking FIG. 1 as an example, the negative x-axis direction becomes the first shaving direction, and the positive x-axis direction becomes the second shaving direction.

FIG. 1 is a perspective view of a razor assembly 10 according to one embodiment of the present disclosure.

As shown in FIG. 1, the razor assembly 10 includes a razor cartridge 110, a connector 120, a recovering force provider 130, and a razor handle 140.

The razor cartridge 110 may include a blade housing 112, at least one shaving blade 114, and one or more guide rails 116.

The blade housing 112 may receive at least one shaving blade 114 in a transverse direction d1 at a seating portion formed in the blade housing 112.

At least one shaving blade 114 has a cutting edge capable of cutting the hair when shaving.

The blade housing 112 may include one or more guide rails 116.

The guide rail 116 may be fitted with a guided shaft member 128 (shown in FIG. 3A) of the connector 120 or penetrated by the guided shaft member 128.

For this purpose, the guide rail 116 may have an elongated groove or an elongated hole parallel to the longitudinal direction d2 of the blade housing 110.

The guided shaft member (128 of FIG. 3A) fitted with the guide rail 116 or penetrating the guide rail 116 may be configured to be movable along the guide rail 116.

In FIG. 1, two guide rails 116 are illustrated as being disposed one by one at both ends of the transverse direction d1 of the blade housing 112, but are not limited thereto.

For example, one guide rail 116 may be disposed in the center of the blade housing 112. In this case, the guided shaft member 128 may be coupled to both side walls of the guide rail 116 or may be movably coupled along the guide rail 116 by penetrating through an elongated hole formed in the guide rail 116.

The connector 120 is disposed between the razor cartridge 110 and razor handle 140 and is responsible for interconnecting the two members.

Figure 3A:
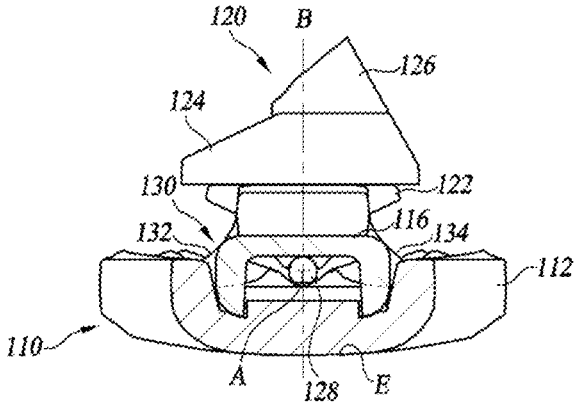
FIGS. 3A and 3B are a side and cross-sectional view and a plan and cross-sectional view of a connector at a first rest position according to one embodiment of the present disclosure.

The connector 120 may include a connector arm 122, a connector hub 124, a hub side connecting portion 126, and the guided shaft member 128 as shown in FIG. 3A.

The connector arm 122 is an area on the connector 120, which is coupled to the blade housing 112 so as to be pivotable about a first pivot axis 'A' parallel to transverse direction d1.

For example, the connector arm 122 may be coupled to the blade housing 112 by having the guided shaft member 128 extending in transverse direction d1 from the sidewalls of the connector arm 122 fitted into an elongate groove formed in the guide rail 116 or penetrating the elongated hole.

One side of the connector hub 124 may be connected to the connector arm 122, and the other side of the connector hub 124 may be connected to the hub side connecting portion 126.

The connector arm 122 may be coupled to the connector hub 124 to be pivotable about a second pivot axis 'B' perpendicular to the cutting surface (FIG. 3A at E) of the blade housing 112, but the disclosure is not limited to this.

For example, the connector arm 122 and the connector hub 124 may be integrally formed or may be coupled so that they are fixed together.

The hub side connecting portion 126 may be coupled with a handle side connecting portion 142 of the razor handle 140, which interconnects the connector 120 and the razor handle 140.

The hub side connecting portion 126 may be configured to be detachably coupled to the handle side connecting portion 142 so that razor cartridge 110 coupled to the connector 120 can be replaced with a new one, although the present disclosure is not so limited.

For example, the hub side connecting portion 126 and the handle side connecting portion 142 may be integrally configured or coupled so as not to be detached.

The guided shaft member 128 may be coupled to the guide rail 116, whereby it can be movably coupled to the razor cartridge 110. Detailed description in this regard will be presented with reference to FIGS. 3A and 3B.

Referring back to FIG. 1, the first pivot axis 'A' is fixed on the guided shaft member 128 and is movable in unison with the guided shaft member 128. Accordingly, the first pivot axis 'A' may move along the guide rail 116 in unison with the guided shaft member 128.

The guided shaft member 128 and the first pivot axis 'A' may be configured to be movable along the guide rail 116 between a first position and a second position spaced apart in the second shaving direction from a first rest position.

Here, the first rest position refers to the position of the guided shaft member 128 on the guide rail 116 when no external force is applied to the razor assembly 10. The first position refers to the limit point at which the guided shaft member 128 can move in the first shaving direction along the guide rail 116. The second position refers to the limit point at which the guided shaft member 128 can move in the second shaving direction.

The recovering force provider 130 may include a first recovering member 132 and a second recovering member 134.

The first recovering member 132 is configured to provide the connector 120 with a recovering force for recovering first pivot axis 'A' to the first rest position when first pivot axis 'A' is located between the first rest position and the first position.

The second recovering member 134 is configured to provide the connector 120 with a recovering force for recovering first pivot axis 'A' to the first rest position when first pivot axis 'A' is located between the first rest position and the second position.

For example, where the first recovering member 132 and the second recovering member 134 are made of an elastic member such as rubber, when the first pivot axis 'A' is located between the first rest position and the first position, the first recovering member 132 may undergo an extension to generate a recovering force for pulling the connector 120 toward the first rest position. In contrast, the second recovering member 134 may undergo a compression to generate a recovering force for pushing the connector 120 to the first rest position.

The recovering force provided by the recovering force provider 130 to the connector 120 may include different forces depending on the materials of the first recovering member 132 and the second recovering member 134.

For example, where the first recovering member 132 and the second recovering member 134 are made of an elastic material, the recovering force may include an elastic force. Where the first recovering member 132 and the second recovering member 134 are made of a magnetic element having magnetic properties, the recovering force may include a magnetic force.

In FIG. 1, the recovering force provider 130 is illustrated as being made of rubber, but the present disclosure is not limited thereto.

For example, the recovering force provider 130 may be made of another elastic member such as a leaf spring, a coil spring, or may be made of a plurality of magnetic elements having magnetic properties. Detailed description in this regard will be provided with reference to FIGS. 11A-11C.

The razor handle 140 is coupled with the connector 120 to provide an area for the user to grasp the razor assembly 10.

The razor handle 140 may include a handle side connecting portion 142, a grip portion 144, and a button portion 146.

The handle side connecting portion 142 is a portion on the razor handle 140, which is engaged with the hub side connecting portion 126. The grip portion 144 is a portion on the razor handle 140, by which the user can grasp the razor handle 140.

The button portion 146 is configured to release the coupling between the handle side connecting portion 142 and the hub side connecting portion 126.

For example, the user may operate the button unit 146 to remove, from the razor handle 140, the connector 120 as well as the razor cartridge 110 connected to the connector 120. This allows the user to replace an old razor cartridge 110 with a new one.

Figure 2:
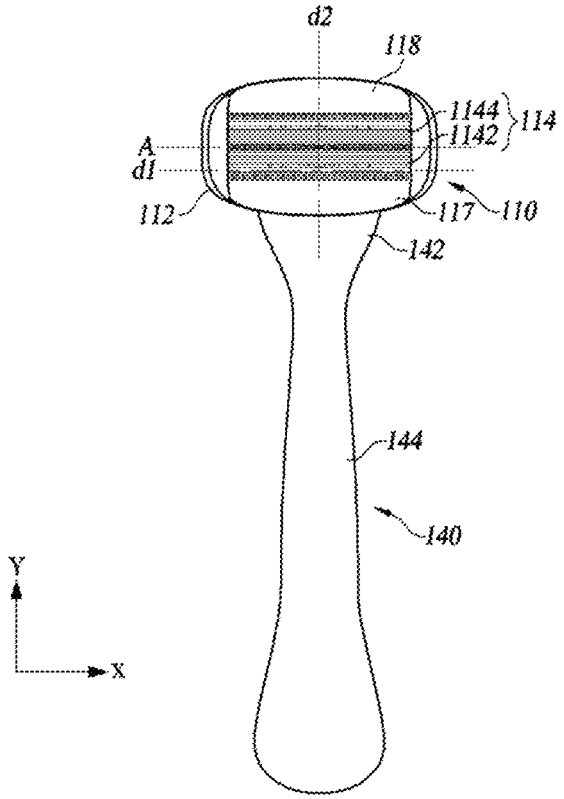
FIG. 2 is an elevational view of a razor assembly according to one embodiment of the present disclosure.

FIG. 2 is an elevational view of a razor assembly 10 according to one embodiment of the present disclosure.

As shown in FIG. 2, the shaving blades 114 may include one or more first blades 1142 and one or more second blades 1144.

The first blade 1142 may be disposed on the blade housing 112 and spaced apart from the second blade 1144 in a first shaving direction.

The first blade 1142 may have a first cutting edge configured to cut the hair when shaving in the first shaving direction.

The second blade 1144 may have a second cutting edge configured to cut the hair when shaving in the second shaving direction.

The blade housing 112 may include a first skin contact member 117 and a second skin contact member 118.

The first skin contacting member 117 is disposed adjacent to the first blade 1142, and the second skin contacting member 118 is disposed adjacent to the second blade 1144.

The first skin contact member 117 and the second skin contact member 118 may define a shaving plane by touching the skin when shaving.

Each of the first skin contact member 117 and the second skin contact member 118 may include one or more of a guard bar and a lubrication band.

For example, either the guard bar or the lubrication band is provided on both the first skin contact member 117 and the second skin contact member 118. Alternatively, a guard bar may be provided on any one of the first skin contact member 117 and the skin contact member 118 while the lubrication band may be provided on the other one of the first skin contact member 117 and the skin contact member 118, which is not provided with a guard bar.

However, the present disclosure is not limited thereto, and both the guard bar and the lubrication band may be configured to be provided on both the first skin contact member 117 and the second skin contact member 118.

The guard bar may stretch the user's skin in the direction in which shaving proceeds before the hair is cut by the shaving blades 114.

As the user's skin is stretched by the guard bar, the user's hair can stand up in a direction perpendicular to the user's skin surface, which facilitates hair cutting by the shaving blades 114.

The guard bar may be made of plastic or rubber, but is not limited thereto. For example, the guard bar may be composed of a plastic frame partially formed with a rubber section.

The lubricating band serves to apply a lubricating material to the user's skin after cutting for smoothing out the skin roughened by the cutting, and it helps to smoothly glide the razor assembly 10.

The lubrication band may be made of, for example, a flexible material, a moisture absorbing porous material, or a shaving aid.

The lubrication band may expand upon contact with water, and may provide a water-soluble material including lubricating ingredients, skin soothing ingredients, and the like to the user's skin.

In the first rest position, the guided shaft member 128 and the first pivot axis 'A' may at least partially overlap the area between the first cutting edge and the first cutting edge when viewed in front of the cutting surface (E of FIG. 3A) of the blade housing 112.

In this case, the guided shaft member 128 is positioned at the center of the blade housing 112 at the first rest position, thereby facilitating the movement of the first pivot axis 'A' along the shaving direction.

Figure 3B:
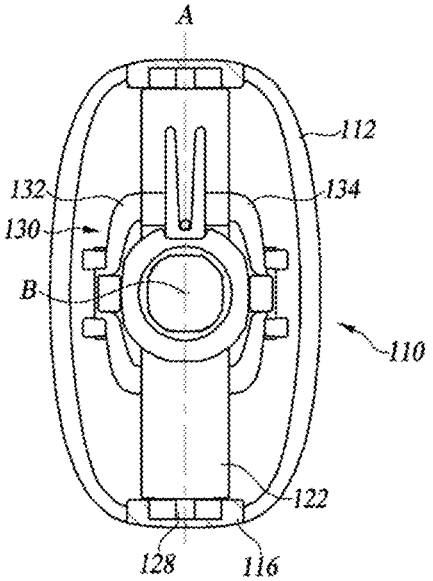

FIGS. 3A and 3B are cross-sectional and rear views of the guided shaft member 128 positioned at the first rest position according to one embodiment of the present disclosure.

Specifically, FIG. 3A is a side and cross-sectional view of the razor cartridge 110 and the connector 120 when the guided shaft member 128 is in the first rest position, and FIG. 3B is a plan and cross-sectional view of the razor cartridge 110 and the connector 120 when the connector 120 is in the first rest position.

In FIG. 3B, for convenience of description, the connector hub 124 and the hub side connecting portion 126 are omitted.

As shown in FIGS. 3A and 3B, the guided shaft member 128 fits into the elongated groove formed in the guide rail 116 or passes through the elongated hole formed in the guide rail 116 to be movably coupled to the razor cartridge 110.

The guided shaft member 128 may extend in transverse direction d1 from both side walls of the connector arm 122.

In FIG. 3B, two pieces of the guided shaft member 128 are illustrated as extending outward in transverse direction d1, but the present disclosure is not limited thereto.

For example, the guided shaft member 128 may be configured as one or two members extending in transverse direction d1 from the connector arm 122.

The first recovering member 132 may be connected at one side to the blade housing 112 and at the other side to the connector 120.

The second recovering member 134 may be connected at one side to the blade housing 112 and at the other side to the connector 120.

When the guided shaft member 128 is in the first rest position, the displacements generated in the first recovering member 132 and the second recovering member 134 may be the same.

Thus, assuming that the first recovering member 132 and the second recovering member 134 have the same elastic modulus, they are subjected to the same elastic force generated by the displacement. In this case, the resultant recovering force applied to the connector 120 may be zero.

Alternatively, when the guided shaft member 128 is in the first rest position, the first recovering member 132 and the second recovering member 134 may be configured to generate no displacement. This incurs no elastic force, leading to the resultant recovering force of zero.

With the zero recovering force applied to the connector 120, the guided shaft member 128 may stop at the first rest position without a change in position.

Figure 4A:
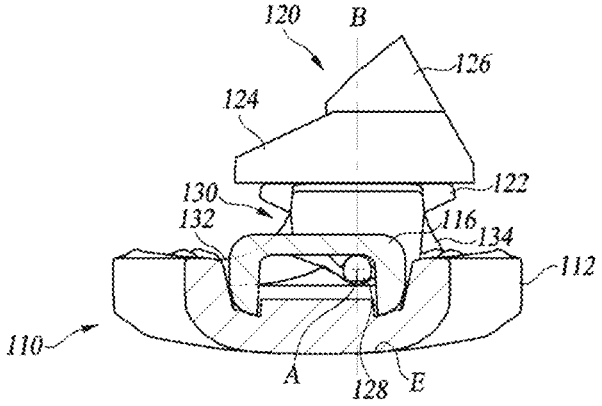
FIGS. 4A and 4B are a side and cross-sectional view and a plan and cross-sectional view of a connector at a first position according to embodiment of the present disclosure.
Figure 4B:
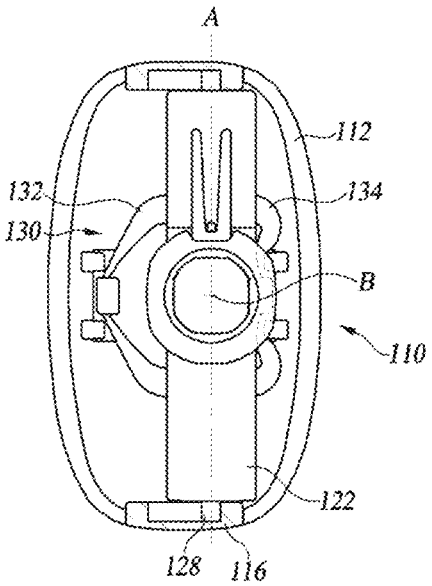

FIGS. 4A and 4B are cross-sectional and rear views of the connector 120 located at a first position according to one embodiment of the present disclosure.

Specifically, FIG. 4A is a side and cross-sectional view of the razor cartridge 110 and the connector 120 when the guided shaft member 128 is in the first position, and FIG. 4B is a plan and cross-sectional view of the razor cartridge 110 and the connector 120 when the guided shaft member 128 is in the first position.

In FIG. 4B, the connector hub 124 and the hub side connecting portion 126 are omitted for convenience of description.

As shown in FIGS. 4A and 4B, when the guided shaft member 128 is in the first position, the first recovering member 132 may be extended and may have a positive displacement. In contrast, the second recovering member 134 may be compressed and may have a negative displacement.

Since the elastic material generates an elastic force in a direction of reducing displacement, the first recovering member 132 may generate an elastic force for pulling the connector 120 in the second shaving direction, and the second recovering member 134 may generate an elastic force for pushing the connector 120 in the second shaving direction. Accordingly, the resultant recovering force is directed in the second shaving direction.

Thus, when no other external force is applied to the razor assembly 10, the guided shaft member 128 may move in the second shaving direction by the resultant recovering force acting in the second shaving direction.

This movement of the guided shaft member 128 may continue up to the first rest position at which the resultant recovering force of the recovering force provider 130 becomes zero.

When the first pivot axis 'A' is located between the first rest position and the first position, the closer the first pivot axis 'A' is to the first position, the greater the positive displacement value of the first recovering member 132 becomes, and the greater the negative displacement value of the second recovering member 134 becomes.

As the displacement increases, the magnitude of the elastic force generated in the first recovering member 132 and the second recovering member 134 also increases, adding to the resultant recovering force. This increase in resilience results in a better handling for user's benefit.

For example, when the displacement values of the recovering members 132 and 134 are small, a relatively small recovering force is generated by the recovering members 132 and 134, thereby providing a smooth handling to the user.

On the contrary, when the displacement values of the recovering members 132 and 134 are large, a relatively large recovering force is generated by the recovering members 132 and 134 to restore the connector 120 displaced so far so quickly to the first rest position. This can prepare the razor assembly 10 after one stroke for the next stroke.

Figure 5A:
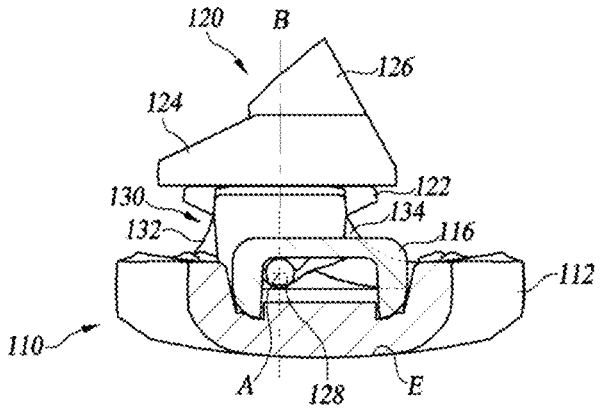
FIGS. 5A and 5B are a side and cross-sectional view and a plan and cross-sectional view of a connector at a second position according to one embodiment of the present disclosure.
Figure 5B:
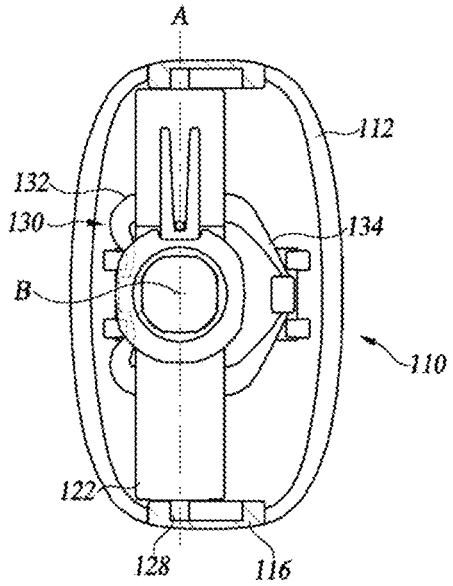

FIGS. 5A and 5B are cross-sectional and rear views of a connector located in a second position according to one embodiment of the present disclosure.

Specifically, FIG. 5A is a side and cross-sectional view of the razor cartridge 110 and the connector 120 when the guided shaft member 128 is in the second position, and FIG. 5B is a plan and cross-sectional view of the razor cartridge 110 and the connector 120 when the guided shaft member 128 is in the second position.

In FIG. 5B, for convenience of explanation, the connector hub 124 and the hub side connecting portion 126 are omitted.

As shown in FIGS. 5A and 5B, when the guided shaft member 128 is in the second position, the first recovering member 132 may be compressed and may have a negative displacement. Conversely, the second recovering member 134 may be extended and may have a positive displacement.

Thanks to the elastic material generating an elastic force in a direction of reducing displacement, the first recovering member 132 generates an elastic force for pushing the connector 120 in the first shaving direction, and the second recovering member 134 generates an elastic force for pulling the connector 120 in the first shaving direction. Accordingly, the resultant recovering force is directed in the first shaving direction.

Thus, when no other external force is applied to the razor assembly 10, the guided shaft member 128 may move in the first shaving direction by the resultant recovering force acting in the first shaving direction.

This movement of the guided shaft member 128 may continue up to the first rest position at which the resultant recovering force becomes zero.

When first pivot axis 'A' is located between the first rest position and the second position, the closer the first pivot axis 'A' is to the second position, the greater the negative displacement value of the first recovering member 132 becomes, and the greater the positive displacement value of the second recovering member 134 becomes.

As the displacement increases, the magnitude of the elastic force generated in the first recovering member 132 and the second recovering member 134 also increases, adding to the resultant recovering force. This increase in resilience facilitates the user's handling of the razor assembly 10.

For example, when the displacement values of the recovering members 132 and 134 are small, a relatively small recovering force is generated by the recovering members 132 and 134, thereby providing a smooth handling to the user.

On the contrary, when the displacement values of the recovering members 132 and 134 are large, a relatively large recovering force is generated by the recovering members 132 and 134 to restore the connector 120 displaced so far so quickly to the first rest position. This can prepare the razor assembly 10 after one stroke for the next stroke.

Figure 6A:
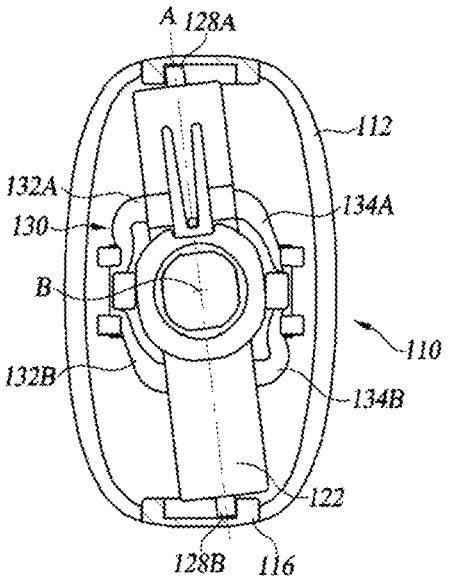
FIGS. 6A and 6B are plan and cross-sectional views of a connector before and after pivoting about a second pivot axis with respect to a blade housing according to one embodiment of the present disclosure.
Figure 6B:
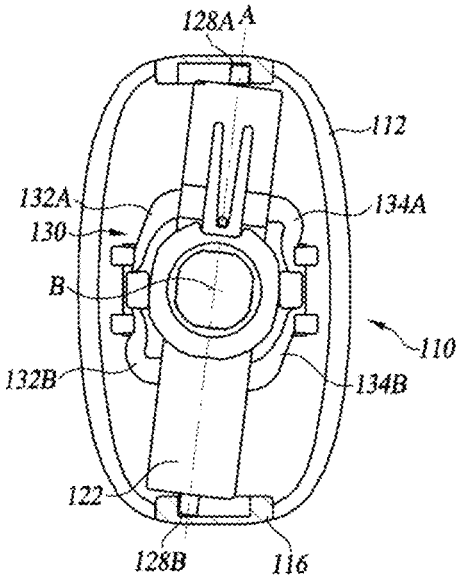

FIGS. 6A and 6B are plan and cross-sectional views of the connector 120 before and after pivoting about second pivot axis 'B' with respect to the blade housing 112 according to one embodiment of the present disclosure.

Specifically, FIG. 6A is a plan and cross-sectional view showing that the connector 120 pivoted counterclockwise about second pivot axis 'B' with respect to the blade housing 112, and FIG. 6B is a plan and cross-sectional view of the connector 120 pivoted clockwise about second pivot axis 'B' with respect to the blade housing 112.

In FIGS. 6A and 6B, the connector hub 124 and the hub side connecting portion 126 are omitted for convenience of description.

As shown in FIG. 3A to FIG. 5B, a space due to tolerance may be formed between the guided shaft member 128 and the opposing inner walls of the guide rail 116, which face the guided shaft member 128 in the direction of the first pivot axis 'A'.

This space is effective to minimize contact between the guided shaft member 128 and the opposing inner walls of the guide rail 116, thereby facilitating smooth movement of the guided shaft member along the guide rail 116.

Further, the space between the guided shaft member 128 and the opposing inner walls of the guide rail 116 may provide a room for the connector 120 to pivot about second pivot axis 'B' with respect to the blade housing 112.

For example, as shown in FIG. 6A, through the space between the guided shaft member 128 and the opposing inner walls of the guide rail 116, the connector arm 122 may be pivoted counterclockwise about second pivot axis 'B' with respect to the blade housing 112.

In this case, the guided shaft member at right side 128A may be adjacent to the second position, and the guided shaft member at left side 128B may be adjacent to the first position.

Accordingly, the first recovering member 132 is compressed at its right region 132A to provide a recovering force that pushes the right-side guided shaft member 128A to the first rest position, and is extended at its left region 132B to provide a recovering force for pulling the left-side guided shaft member 128B to the first rest position.

Conversely, the second recovering member 134 is extended at its right region 134A to provide a recovering force that pulls the right-side guided shaft member 128A to the first rest position, and is compressed at its left region 134B to provide a recovering force for pushing the left-side guided shaft member 128B to the first rest position.

As a result, when the connector arm 122 pivots counterclockwise about second pivot axis 'B' with respect to the blade housing 112, the first recovering member 132 and the second recovering member 134 may provide a recovering force for recovering the right-side guided shaft member 128A and the left-side guided shaft member 128B to the first rest position, that is, a recovering force for pivoting the connector 120 clockwise.

As shown in FIG. 6B, through the space between the guided shaft member 128 and the opposing inner walls of the guide rail 116, the connector arm 122 may be pivoted clockwise about second pivot axis 'B' with respect to the blade housing 112.

In this case, the right-side guided shaft member 128A may be adjacent to the first position, and the left-side guided shaft member 128B may be adjacent to the second position.

Accordingly, the first recovering member 132 is extended at its right region 132A to provide a recovering force that pulls the right-side guided shaft member 128A to the first rest position, and is compressed at its left region 132B to provide a recovering force for pushing the left-side guided shaft member 128B to the first rest position.

Conversely, the second recovering member 134 is compressed at its right region 134A to provide a recovering force that pushes the right-side guided shaft member 128A to the first rest position, and is extended at its left region 134B to provide a recovering force for pulling the left-side guided shaft member 128B to the first rest position.

As a result, when the connector arm 122 pivots clockwise about second pivot axis 'B' with respect to the blade housing 112, the first recovering member 132 and the second recovering member 134 may provide a recovering force for recovering the right-side guided shaft member 128A and the left-side guided shaft member 128B to the first rest position, that is, a recovering force for pivoting the connector 120 counterclockwise.

The razor assembly 10 according to one embodiment of the present disclosure may be configured to allow connector 120 to be pivotable with respect to the blade housing 112 in a predetermined angular range about second pivot axis 'B' by using the space between the guided shaft member 128 and the opposing inner walls of the guide rail 116.

Therefore, the blade housing 112 according to one embodiment of the present disclosure may be configured to be pivotable with respect to the connector 120 and up to the razor handle 140 connected to the connector 120 in a predetermined angular range about second pivot axis 'B'.

Figure 7A:
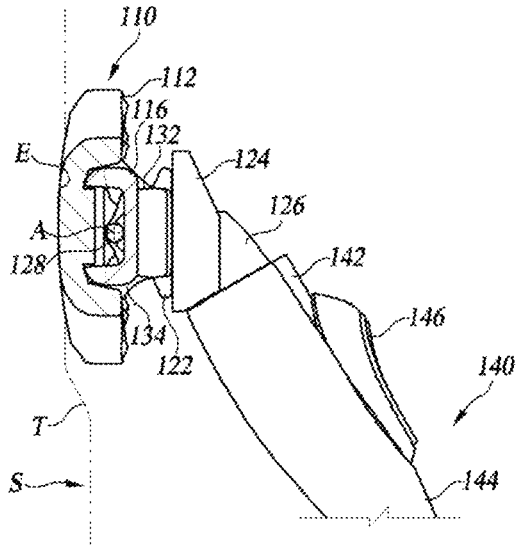
FIGS. 7A and 7B are views illustrating movement of a blade housing and a razor handle when a load is applied to the blade housing during shaving according to one embodiment of the present disclosure.
Figure 7B:
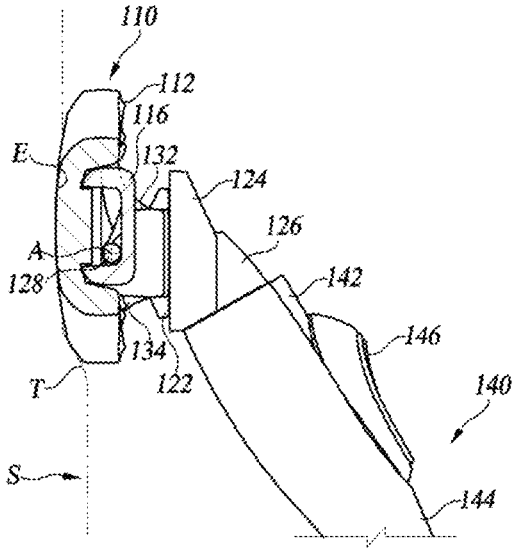

FIG. 7A and FIG. 7B are views illustrating movement of the blade housing 112 and the razor handle 140 when a load is applied to the blade housing 112 during shaving according to one embodiment of the present disclosure.

Specifically, FIG. 7A illustrates a situation in which a load is started to be applied to the blade housing 112 moving in the first shaving direction, and FIG. 7B illustrates a situation right after a load is applied to the blade housing 112.

As shown in FIG. 7A, when shaving in the first shaving direction, the blade housing 112 may move in that direction while being in contact with a skin contacting surface 'S'.

As cutting surface 'E' and skin contacting surface 'S' of the blade housing 112 come into contact with each other, a frictional force may be generated on the blade housing 112.

This frictional force acts in a second shaving direction opposite to the direction of movement of the blade housing 112 and thus hinders movement of the blade housing 112 in the first shaving direction.

Meanwhile, the connector 120 is configured to allow the guided shaft member 128 to move along the guide rail 116, so that the guided shaft member 128 can move in the first shaving direction in unison with the razor handle 140.

By this time, the guided shaft member 128 may have been slightly moved away from the first rest position toward the first position. In this case, the first recovering member 132 may be extended and the second recovering member 134 may be compressed.

As shown in FIG. 7B, the blade housing 112 may be caught by flections 'T' formed on skin contacting surface 'S', generating a large load on the blade housing 112.

This load may occur not only when the blade housing 112 is caught by flections 'T' on skin contacting surface 'S', but also when the bend of skin contacting surface 'S' is severe or when cutting the thick hair.

When such a load is applied to the blade housing 112, additional resistance may be generated in the second shaving direction on top of the frictional force generated in cutting surface 'E' of the blade housing 112.

This resistive force may further impede the movement of the blade housing 112 in the first shaving direction, which can bring the blade housing 112 to a momentary stop on skin contacting surface 'S'.

Meanwhile, the guided shaft member 128 may be located closer to the first position along the guide rail 116. In this case, the first recovering member 132 may be extended more and the second recovering member 134 may be compressed more.

This will further increase the magnitude of the recovering force generated in the first recovering member 132 and the second recovering member 134.

At this time, the resultant recovering force generated in the recovering force provider 130 is directed in the first shaving direction, which can alleviate the frictional force and a part of the resistance due to the load acting in the second shaving direction on the blade housing 112.

When the guided shaft member 128 is sufficiently moved toward the first position such that the resultant recovering force generated by the recovering force provider 130 can withstand the frictional and resistive forces acting on the blade housing 112, the blade housing 112 can move out of the momentary stop and move back to the first shaving direction.

In order for the resultant recovering force generated by the recovering force provider 130 to overcome the frictional and resistive forces acting on the blade housing 112, the guided shaft member 128 needs to be moved to a sufficient degree, which may take some time for that movement.

Such time consumption may be used as an opportunity for alerting the user of a heavy load occurred in the blade housing 112.

For example, a user may be aware of a situation in which the blade housing 112 stops during shaving, and then perform a safe shaving by reducing a force applied to the razor assembly 10 or by varying the pivot angle of the razor handle 140.

FIGS. 7A and 7B illustrate an exemplary shaving in the first shaving direction, but the present disclosure is not limited thereto. Therefore, the description related to FIGS. 7A and 7B can be equally applied to the second shaving direction.

Figure 8A:
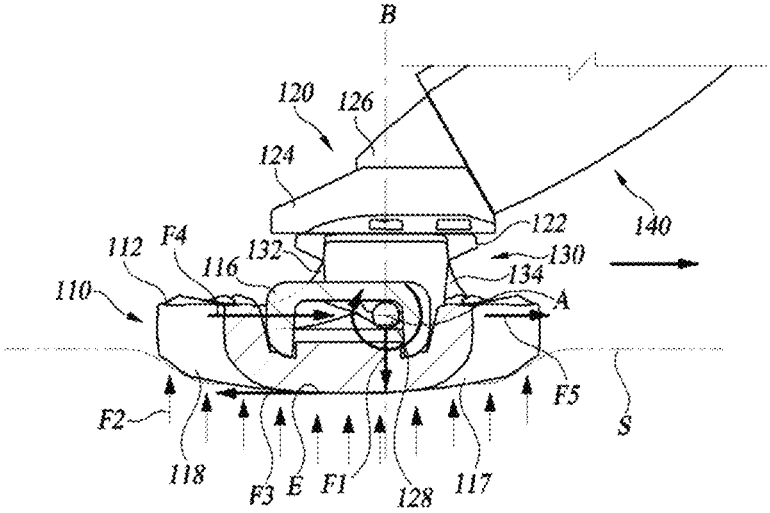
FIGS. 8A and 8B are views illustrating a change in the distribution of force applied to the blade housing according to the movement of a first pivot axis according to one embodiment of the present disclosure.
Figure 8B:
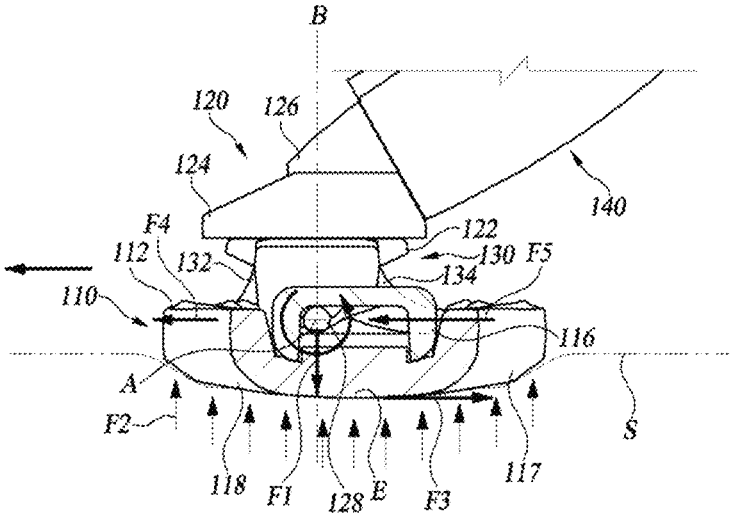

FIGS. 8A and 8B are views illustrating a change in the distribution of force applied to the blade housing 112 according to the movement of first pivot axis 'A' according to one embodiment of the present disclosure.

Specifically, FIG. 8A is a diagram of the blade housing 112 and the razor handle 140 when the first pivot axis 'A' is in the first position. FIG. 8B shows when first pivot axis 'A' is in the second position.

As shown in FIGS. 8A and 8B, when in shaving, the blade housing 112 may receive a vertical pressing force F1, a normal force F2, a horizontal frictional force F3, a first horizontal recovering force F4 and a second horizontal recovering force F5 acting thereon.

The vertical pressing force F1 refers to the force exerted downward on the blade housing 112 by the connector 120, and the normal force F2 refers to the force exerted upward on the blade housing 112 by skin contacting surface 'S'.

The normal force F2 may be evenly distributed on cutting surface 'E' of the blade housing 112 where the blade housing 112 is in contact with skin contacting surface 'S'.

The horizontal frictional force F3 refers to the frictional force generated between cutting surface 'E' of the blade housing 112 and skin contacting surface 'S' while cutting surface 'E' of the blade housing 112 passes through skin contacting surface 'S'.

The first horizontal recovering force F4 refers to the force applied to the blade housing 112 in the horizontal direction by the recovering force generated by the first recovering member 132. The second horizontal recovering force F4 refers to the force applied to the blade housing 112 in the horizontal direction by the recovering force generated by the second recovering member 134.

As shown in FIG. 8A, when first pivot axis 'A' is in the first position, the normal force F2 can act on the blade housing 112 more extensively at its left region than its right region with respect to second pivot axis 'B'.

Accordingly, the resultant normal force applied to the left region of the blade housing 112 is greater than that applied to the right region of the blade housing 112.

In addition, the horizontal frictional force F3 may act in the second shaving direction opposite the moving direction of the blade housing 112 when shaving in the first shaving direction.

In addition, when shaving in the first shaving direction, the first recovering member 132 is extended and the second recovering member 134 is compressed, so that both first horizontal recovering force F4 and second horizontal recovering force F5 can act in the shaving direction.

Vertical pressing force F1, first horizontal recovering force F4, and second horizontal recovering force F5 may have substantially codirectional line of force and moment arm with respect to first pivot axis A.

Accordingly, no moment is generated on the blade housing 112 by vertical pressing force F1, first horizontal recovering force F4, and second horizontal recovering force F5.

On the contrary, a moment may be generated on the blade housing 112 by normal force F2 and horizontal frictional force F3 that have noncoinciding directions of the line of the force and the moment arm with respect to first pivot axis 'A'.

As a result, normal force F2 acts on the blade housing 112 to a greater extent at its left region than its right region with respect to second pivot axis 'B' while horizontal frictional force F3 acts on the second shaving direction, thereby generating a moment on the blade housing 112 in a first pivoting direction about first pivot axis 'A'.

Here, the first pivoting direction means a pivoting direction in which the razor handle 140 is laid with respect to the blade housing 112. For example, FIG. 8A illustrates the first pivoting direction that is clockwise.

As shown in FIG. 8B, when the first pivot axis 'A' is in the second position, the normal force F2 can act on the blade housing 112 more extensively at its right region than its left region with respect to second pivot axis 'B'.

Accordingly, the resultant normal force applied to the right region of the blade housing 112 is greater than that applied to the left region of the blade housing 112.

In addition, horizontal frictional force F3 may act in a first shaving direction opposite the moving direction of the blade housing 112 when shaving in the second shaving direction.

In addition, when shaving in the second shaving direction, the first recovering member 132 is compressed and the second recovering member 134 is extended, for causing first horizontal recovering force F4 and second horizontal recovering force F5 to commonly act in the second shaving direction.

As described above in the description associated with FIG. 8A, the moment acting on the blade housing 112 may be generated primarily by normal force F2 and horizontal frictional force F3.

As a result, normal force F2 acts on the blade housing 112 to a greater extent at its right region than its left region with respect to second pivot axis 'B' while horizontal frictional force F3 acts on the first shaving direction, thereby generating a moment on the blade housing 112 in a second pivoting direction about first pivot axis 'A'.

Here, the second pivoting direction means a pivoting direction in which the razor handle 140 is erected with respect to the blade housing 112. For example, FIG. 8B illustrates the second pivoting direction that is counterclockwise.

Moment in the first pivoting direction or the second pivoting direction according to the movement of first pivot axis 'A' can provide a better handling to the user of the razor assembly, specifically, the two-way wet razor assembly. The detailed description in this regard will be given with reference to FIGS. 9A and 9B.

In addition, such a moment in the first pivoting direction or the second pivoting direction, when shaving, may depress the respective skin contact members 117, 118 disposed on the blade housing 112, thereby improving the guard function or the lubrication performance of the skin contact members 117, 118.

For example, when the user is shaving in the first shaving direction, the first skin contact member 117 may depress skin contacting surface 'S' more firmly while the moment in the first pivoting direction is generated in the blade housing 112.

This can further improve the function of the guard bar or the lubrication band included in the first skin contact member 117.

Specifically, where the first skin contact member 117 includes a guard bar, the guard bar can perform better by depressing skin contacting surface 'S' more firmly.

Where the first skin contact member 117 includes a lubrication band instead, the lubrication band can perform improved lubrication application by depressing skin contacting surface 'S' more firmly.

These effects can be equally applied to the guard bar or lubrication band included in the second skin contact member 118 when the user shaves in the second shaving direction.

Figure 9A:
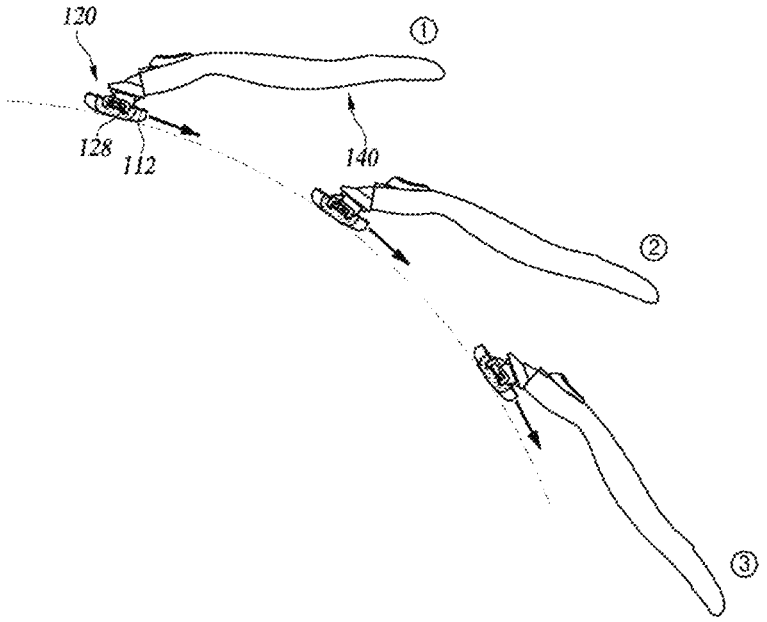
FIGS. 9A and 9B are views illustrating pivoting of a blade housing according to one embodiment of the present disclosure when shaving along a curved surface.
Figure 9B:
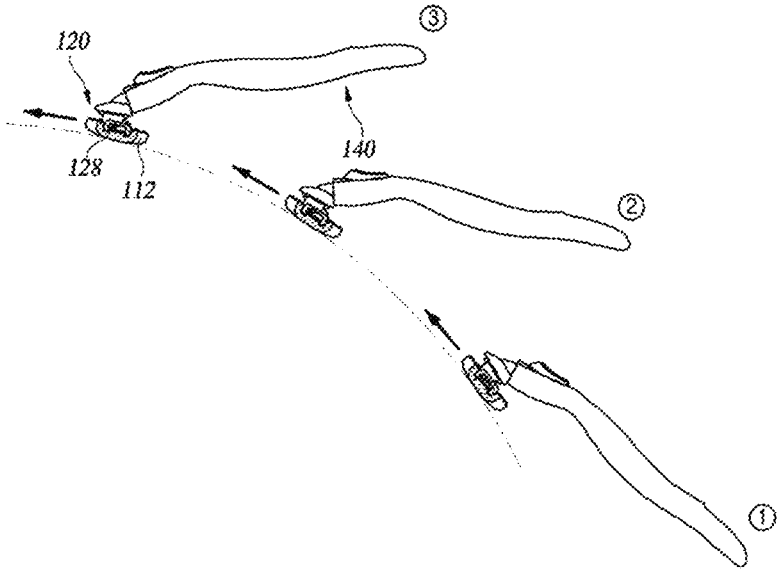

FIGS. 9A and 9B illustrate pivoting of the blade housing 112 according to one embodiment of the present disclosure when shaving along a curved surface.

Specifically, FIG. 9A illustrates shaving along a curved surface in a first shaving direction, and FIG. 9B illustrates shaving along a curved surface in a second shaving direction.

As shown in FIG. 9A, when shaving in the first shaving direction, the blade housing 112 meets with a resistance in the second shaving direction by the frictional force generated between cutting surface 'E' of the blade housing 112 and skin contacting surface 'S'.

Accordingly, the movement of the blade housing 112 is slowed down, and the guided shaft member 128 is moved to the first position.

In this case, the blade housing 112 remains in contact with skin contacting surface 'S', which generates the moment in the first pivoting direction on the blade housing 112 as shown in FIG. 8A.

Meanwhile, when shaving in the first shaving direction along the curved surface, the blade housing 112 is pivoted in the first pivoting direction.

Accordingly, the moment in the first pivoting direction generated in the blade housing 112 while first pivot axis 'A' is moved to the first position can maintain a constant contact between the blade housing 112 and skin contacting surface 'S', thereby providing a better handling to the user.

As shown in FIG. 9B, when shaving in the first shaving direction, the blade housing 112 meets with a resistance in the second shaving direction by the frictional force generated between cutting surface 'E' of the blade housing 112 and skin contacting surface 'S'.

This slows down the movement of the blade housing 112, and the guided shaft member 128 is moved to the second position.

In this case, the blade housing 112 remains in contact with skin contacting surface 'S', which generates the moment in the second pivoting direction on the blade housing 112 as shown in FIG. 8B.

Meanwhile, when shaving in the second shaving direction along the curved surface, the blade housing 112 is pivoted in the second pivoting direction.

Accordingly, the moment in the second pivoting direction generated in the blade housing 112 while first pivot axis 'A' is moved to the second position can maintain a constant contact between the blade housing 112 and skin contacting surface 'S', thereby providing a better handling to the user.

The razor assembly 10 according to one embodiment of the present disclosure may generate an appropriate moment in the blade housing 112 by naturally moving the position of first pivot axis 'A' along the shaving direction. This has the effect of providing a better handling to the user. This effect can be maximized in a two-way wet razor with two shaving directions.

Figure 10A:
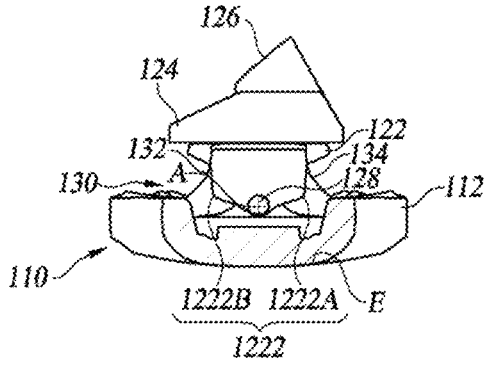
FIGS. 10A to 10C are views illustrating that a connector is pivoted when a first pivot axis is in a first rest position according to one embodiment of the present disclosure.
Figure 10B:
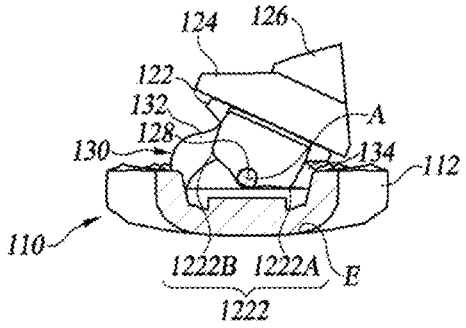
Figure 10C:
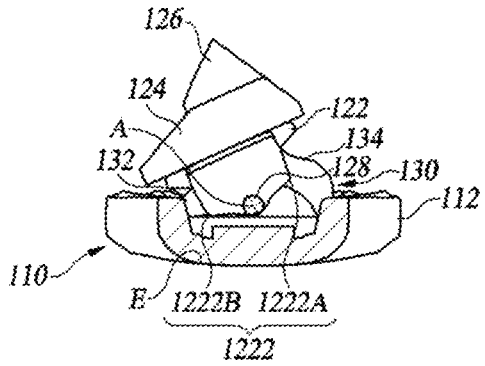

FIGS. 10A to 10C are views illustrating that the connector 120 is pivoted when first pivot axis 'A' is in a first rest position according to one embodiment of the present disclosure.

Specifically, FIG. 10A shows that the connector 120 is in the second rest position, FIG. 10B shows that the connector 120 is pivoted in the first pivoting direction, and FIG. 10C shows the connector 120 is pivoted in the second pivoting direction.

Here, the second rest position refers to a position of the connector 120 where it is not pivoted about first pivot axis 'A' with respect to the blade housing 112.

As shown in FIG. 10A, when the connector 120 is in the second rest position, the displacements generated in the first recovering member 132 and the second recovering member 134 may be the same.

Accordingly, the elastic force generated by the displacement on the first recovering member 132 and the second recovering member 134 may be equal in magnitude. In this case, the resultant recovering force applied to the connector 120 may be zero. However, the present disclosure is not limited thereto.

For example, when the connector 120 is in the second rest position, the first recovering member 132 and the second recovering member 134 may be in a state of generating no displacement. This generates no elastic force in the first recovering member 132 and the second recovering member 134, leading to zero resultant recovering force of the recovering force provider 130.

With zero recovering force applied to the connector 120, the connector 120 may maintain the second rest position without pivoting or rotation.

As shown in FIG. 10B, when the guided shaft member 128 is in the first rest position, and where the connector 120 is pivoted in the first pivoting direction, the first recovering member 132 causes a positive displacement to occur.

This generates an elastic force in the first recovering member 132 for urging the connector 120 to pivot in the second pivoting direction.

Accordingly, the first recovering member 132 may provide the connector 120 with a recovering force for restoring the same to the second rest position when the connector 120 pivots in the first pivoting direction about first pivot axis 'A' past the second rest position.

Conversely, while a negative displacement occurs in the second recovering member 134, an elastic force or recovering force is also generated in the second recovering member 134 for urging the connector 120 to pivot in the second pivoting direction.

As shown in FIG. 10C, when the guided shaft member 128 is in the first rest position, and where the connector 120 is pivoted in the second pivoting direction, the second recovering member 134 causes a positive displacement to occur.

This generates an elastic force in the second recovering member 134 for urging the connector 120 to pivot in the first pivoting direction.

Accordingly, the second recovering member 134 may provide the connector 120 with a recovering force for restoring the same to the second rest position when the connector 120 pivots in the second pivoting direction about first pivot axis 'A' past the second rest position.

Conversely, while a negative displacement occurs in the first recovering member 132, an elastic force or recovering force is also generated in the first recovering member 132 for urging the connector 120 to pivot in the first pivoting direction.

Therefore, the recovering members 132 and 134 according to one embodiment of the present disclosure can provide a recovering force to the translation motion of first pivot axis 'A' moving along the guide rail 116, and at the same time, provide a recovering force to the pivoting motion of first pivot axis 'A' as well.

FIGS. 10A to 10C illustrate pivoting when the guided shaft member 128 is in the first rest position, but the present disclosure is not limited thereto. Thus, the description with regard to FIGS. 10A to 10C may equally apply to the guided shaft member 128 when in the first or second position.

In FIGS. 10A to 10C, the first recovering member 132 may have one side connected to the blade housing 112 and the other side connected to the connector 120.

In this case, at the first rest position, one side and the other side of the first recovering member 132 may be spaced apart from first pivot axis 'A' in the first shaving direction. When the connector 120 pivots in the first pivoting direction, the moment in the second pivoting direction is generated by the first recovering member 132 in the connector 120.

In this moment, the moment arm is a straight line connecting first pivot axis 'A' with the other side of the first recovering member 132, and the line of force is a straight line connecting one side of the first recovering member 132 with the other side thereof.

The magnitude of the moment increases as the angle between the moment arm and the line of force approaches the right angle.

Accordingly, the closer the right angle is formed between a straight line that connects first pivot axis 'A' with the other side of the first recovering member 132 and a straight line that connects one side of the first recovering member 132 with the other side thereof, the greater the magnitude of the recovering force for the pivoting in the first pivoting direction.

For this purpose, in the first rest position, the other side of the first recovering member 132 is preferably located above one side of the first recovering member 132 relative to cutting surface 'E' of the blade housing 112.

The second recovering member 134 may have one side connected to the blade housing 112 and the other side connected to the connector 120.

In this case, at the first rest position, one side and the other side of the second recovering member 134 may be spaced apart from first pivot axis 'A' in the second shaving direction.

For the purpose of increasing the magnitude of the recovering force generated by the second recovering member 134, the other side of the second recovering member 134 is also preferably located above one side of the second recovering member 134 relative to cutting surface 'E' of the blade housing 112.

In FIGS. 10A to 10C, the connector 120 may include a stopper 1222. Specifically, the connector 120 may include a first stopper 1222A for the first pivoting direction and a second stopper 1222B for the second pivoting direction.

The stopper 1222 serves to limit the pivot angle of the connector 120 to a certain angle range by contacting the blade housing 112 when the connector 120 pivots in the first or second pivoting direction.

As shown in FIG. 10A, when the connector 120 is in the second rest position, the stopper 1222 does not contact the blade housing 112, so that the connector 120 may pivot in the first pivoting direction or the second pivoting direction.

As shown in FIG. 10B, when the connector 120 is pivoted by a predetermined angle or more in the first pivoting direction, the first stopper 1222A may contact the blade housing 112, whereby the connector 120 may no longer pivot in the first pivoting direction.

As shown in FIG. 10C, when the connector 120 is pivoted by a predetermined angle or more in the second pivoting direction, the second stopper 1222B may contact the blade housing 112, whereby the connector 120 may no longer pivot in the second pivoting direction.

As shown in FIGS. 10A to 10C, the stopper 1222 contacts the blade housing 112 to limit the pivot angle of the connector 120 about first pivot axis 'A' based on the second rest position to the range of 10 degrees to 30 degrees in the first pivoting direction and the second pivoting direction, respectively.

One-way wet razors are generally configured to pivot in an angular range of 30 degrees to 50 degrees for natural handling. However, with two-way wet razor, such a pivot range may excessively bend the user's wrist when switching the shaving direction.

The razor assembly 10 according to at least one embodiment of the present disclosure can minimize excessive bending of the user's wrist when switching the shaving direction by utilizing the stopper 1222 for limiting the pivot range of the connector 120 to the range between 10 degrees and 30 degrees.

Further, the razor assembly 10 may be configured so that, when the stopper 1222 is in contact with the blade housing 122, at least a portion of the area of the connector 120 between the stopper 1222 and the guided shaft member 128 is spaced apart from the blade housing 112.

This may reduce the contact area between the connector 120 and the blade housing 112 during shaving with the connector 120 pivoted.

As a result, the friction generated between the connector 120 and the blade housing 112 can be reduced to provide a better handling to the user.

Figure 11A:
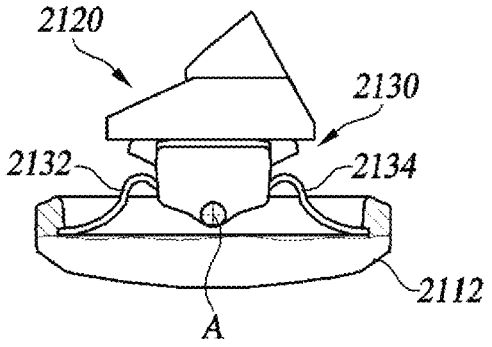
FIGS. 11A to 11C are diagrams of various embodiments of a recovering force provider according to the present disclosure.
Figure 11B:
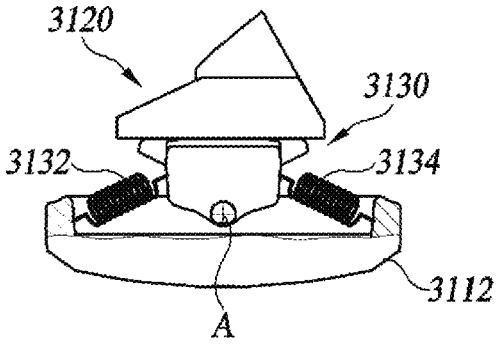
Figure 11C:
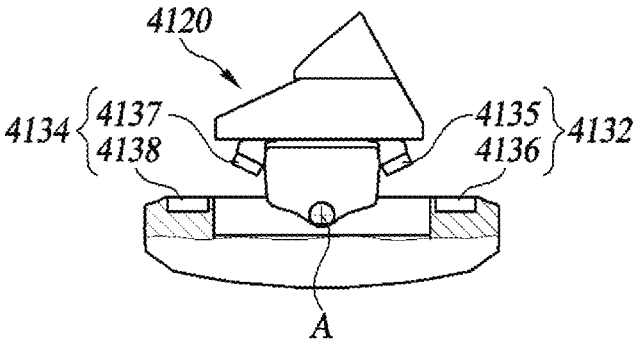

FIGS. 11A to 11C are diagrams of a recovering force provider according to various embodiments of the present disclosure.

In FIG. 1 to FIG. 10C, the first recovering member 132 and the second recovering member 134 are made of rubber, but the present disclosure is not limited thereto. FIGS. 11A to 11C illustrate embodiments that utilize non-rubber materials for making the first recovering member 132 and the second recovering member 134.

As shown in FIG. 11A, a first recovering member 2132 and a second recovering member 2134 included in a recovering force provider 2130 may be leaf springs.

In this case, one end of each leaf spring may be connected to a blade housing 2112, the other end may be connected to a connector 2120.

The first recovering member 2132 and the second recovering member 2134 formed of leaf springs generate an elastic force by bending or extending the leaf springs constituting each member, thereby providing recovering force to the connector 2120.

As shown in FIG. 11B, a first recovering member 3132 and a second recovering member 3134 included in a recovering force provider 3130 may be formed of a coil spring.

In this case, each coil spring may have one end connected to a blade housing 3112 and the other end connected to a connector 3120.

The first recovering member 3132 and the second recovering member 3134 made of a coil spring may be configured to have an elastic force generated by the coil spring being extended or compressed, as with the rubber material, thereby providing the connector 3120 with a recovering force.

As shown in FIG. 11C, a first recovering member 4132 includes a plurality of first magnetic elements 4135 and 4136, and a second recovering member 4134 includes a plurality of second magnetic elements 4137 and 4138.

In this case, the recovering force provided by the first recovering member 4132 to the connector 4120 may include a magnetic force generated by the plurality of first magnetic elements 4135 and 4136. The recovering force provided by the second recovering member 4134 to the connector 4120 may include a magnetic force generated by the plurality of second magnetic elements 4137 and 4138.

For example, as shown in FIG. 11C, the magnetic elements 4135 and 4136 and the magnetic elements 4137 and 4138 disposed adjacent to each other may be arranged such that the same poles face each other.

In this case, a repulsive magnetic force may occur between the adjacent magnetic elements 4135 and 4136 and between the adjacent magnetic elements 4137 and 4138, and thus, the razor assembly may be configured to provide a recovering force to the connector 4120.

In this case, unlike the embodiments with an elastic material such as rubber, leaf spring, or coil spring used for the recovering members, the first recovering member 4132 may be located adjacent to the first position, and the second recovering member 4134 may be located adjacent to the second position.

FIGS. 11A to 11C illustrate various embodiments of a recovering force provider, but the present disclosure is not limited thereto. Thus, the recovering force provider of the present disclosure may be according to other various embodiments as long as they provide a recovering force to the connector.

Further embodiments of the present disclosure shown in FIGS. 12A to 12C, described below, differ from some embodiments of the present disclosure shown in FIGS. 1-10C in that at least a portion of a path of a guided shaft member moving along a guide rail includes a curved section. Hereinafter, descriptions will be made mainly on distinctive features according to further exemplary embodiments of the present disclosure, avoiding repeated descriptions of components substantially the same as those of the aforementioned embodiments.

Figure 12A:
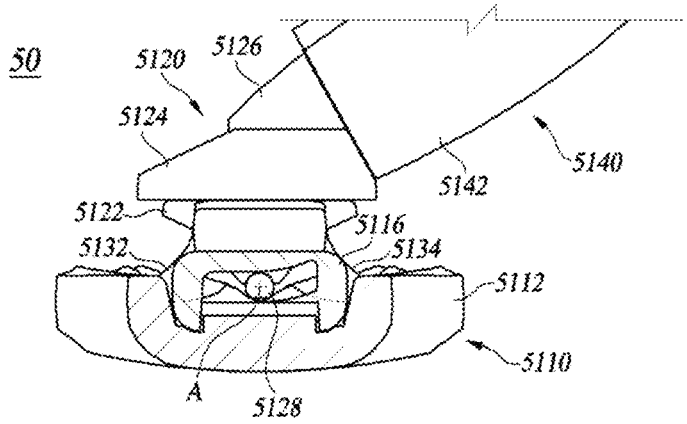
FIGS. 12A to 12C are views illustrating movements of a first pivot axis of a razor assembly according to further embodiments of the present disclosure.
Figure 12B:
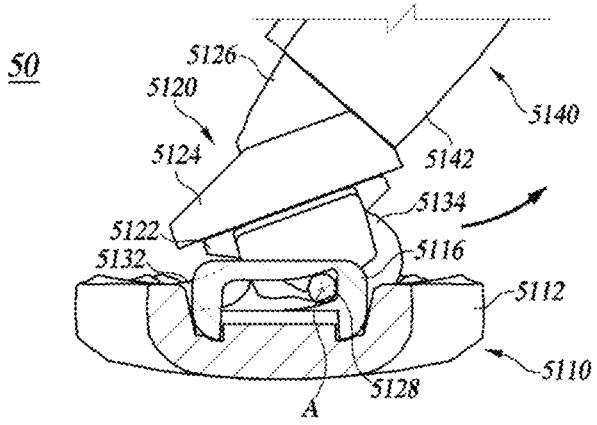
Figure 12C:
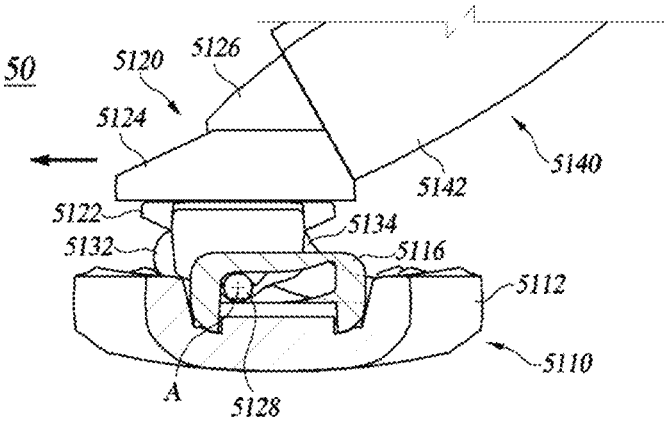

FIGS. 12A to 12C are views illustrating a movement of first pivot axis 'A' of a razor assembly 50 according to further embodiments of the present disclosure.

Specifically, FIG. 12A shows first pivot axis 'A' when located in the first rest position, FIG. 12B shows first pivot axis 'A' when located in the first position, and FIG. 12C shows first pivot axis 'A' when located in the second position.

As shown in FIG. 12A, a guided shaft member 5128 moves along a guide rail 5116 takes a path which may have a curved section at least partially.

Specifically, the path of the guided shaft member 5128 moving from the first rest position to the first position along the guide rail 5116 may be a downward convex curved with respect to a cutting plane 'E' of a blade housing 5112 such that the downward convex is curved away from the cutting plane 'E'.

In this case, the guided shaft member 5128 in the first position may be higher than the guided shaft member 5128 in the first rest position relative to cutting surface 'E' of the blade housing 5112 such that a first distance between the cutting surface 'E' and the guided shaft member 5128 in the first position is greater than a second distance between the cutting surface 'E' and the guided shaft member 5128 in the first rest position.

As shown in FIG. 12B, when the guided shaft member 5128 moves to the first position along the guide rail 5116, the connector 5120 may be pivoted in the second pivoting direction naturally thanks to the curved path between the first rest position and the first position.

As shown in FIG. 12C, when the guided shaft member 5128 moves from the first position to the second position along the guide rail 5116, it follows the curved path between the first rest position and the first position, and thereby the connector 5120 may be restored to the second rest position while naturally pivoting in the first pivoting direction.

With this structure, when switching the shaving direction from the first shaving direction to the second shaving direction, the shaving handle 5140 may be configured to naturally depress the blade housing 5112 in the second shaving direction. This effects smooth switching of the shaving direction in the two-way wet razors.

FIGS. 12A to 12C illustrate the curve only at the path of the guided shaft member 5128 moving from the first rest position to the first position along the guide rail 5116, but the present disclosure is not limited thereto.

For example, the path of the guided shaft member 5128 moving from the first rest position to the second position along the guide rail 5116 may also be curved. In this case, the path of the guided shaft member 5128 moving along the guide rail 5116 may have a generally "U" shape.

As described above, according to one embodiment of the present disclosure, the razor assembly has an effect of providing a safe shaving and proper handling to the user by appropriately moving the pivot axis according to the shaving direction or the degree of load applied to the blade housing.

Although exemplary embodiments of the present disclosure have been described for illustrative purposes, those skilled in the art will appreciate that various modifications, additions and substitutions are possible, without departing from the various characteristics of the disclosure. Therefore, exemplary embodiments of the present disclosure have been described for the sake of brevity and clarity. The scope of the technical idea of the present embodiments is not limited by the illustrations. Accordingly, one of ordinary skill would understand the scope of the disclosure is not limited by the above explicitly described embodiments but by the claims and equivalents thereof.

What is claimed is:

1. A razor assembly, comprising:

a razor cartridge comprising:

at least one shaving blade having a cutting edge; and a blade housing configured to receive the at least one shaving blade in a transverse direction;

a connector extending in parallel with the transverse direction and configured to be coupled to the blade housing so as to be pivotable around a pivot axis with respect to the blade housing, wherein the pivot axis is movable in a direction perpendicular to the transverse direction between a first rest position and a first position spaced apart from the first rest position in a first shaving direction; and a recovering force provider comprising a first recovering force provider configured to provide the connector with a first recovering force for recovering the pivot axis to the first rest position when the pivot axis is located between the first rest position and the first position.

2. The razor assembly of claim 1, wherein:

the at least one shaving blade comprises:

a first blade having a first cutting edge configured to cut hair in the first shaving direction; and a second blade having a second cutting edge configured to cut hair in a second shaving direction opposite the first shaving direction;

the pivot axis is further movable between the first position and a second position spaced apart from the first rest position in the second shaving direction; and the recovering force provider further comprises a second recovering force provider configured to provide the connector with a first recovering force for recovering the pivot axis to the first rest position when the pivot axis is located between the first rest position and the second position.

3. The razor assembly of claim 2, wherein:

the first recovering force provider is further configured to provide the connector with a second recovering force to restore the connector to a second rest position when the connector pivots about the pivot axis in a first pivoting direction past the second rest position; and the second recovering force provider is further configured to provide the connector with a second recovering force to restore the connector to the second rest position when the connector pivots about the pivot axis in a second pivoting direction opposite the first pivoting direction past the second rest position.

4. The razor assembly of claim 3, wherein each of the first recovering force provider and the second recovering force provider comprises elastic materials.

5. The razor assembly of claim 3, wherein:

the first recovering force provider comprises a plurality of first magnetic elements, and the second recovering force provider comprises a plurality of second magnetic elements; and the recovering forces provided by the first recovering force provider to the connector comprises a magnetic force generated by the plurality of first magnetic elements, and the recovering forces provided by the second recovering force provider to the connector comprises a magnetic force generated by the plurality of second magnetic elements.

6. The razor assembly of claim 2, wherein:

when the pivot axis is located between the first rest position and the first position, a magnitude of the recovering force for the first recovering force provider to restore the pivot axis to the first rest position increases as the pivot axis moves closer the first position; and when the pivot axis is located between the first rest position and the second position, a magnitude of the recovering force for the second recovering force provider to restore the pivot axis to the first rest position increases as the pivot axis moves closer to the second position.

7. The razor assembly of claim 2, further comprising a razor handle coupled to the connector, wherein the pivot axis is configured to:

move from the first rest position toward the first position when the razor cartridge is moved for shaving in the first shaving direction; and move from the first rest position toward the second position when the razor cartridge is moved for shaving in the second shaving direction.

8. The razor assembly of claim 1, wherein the connector comprises a stopper, the stopper being configured to contact the blade housing to limit a range of the pivoting of the connector about the pivot axis.

9. The razor assembly of claim 8, wherein:

the connector further comprises a guided shaft member; and at least a portion of an area of the connector between the stopper and the guided shaft member is spaced apart from the blade housing when the stopper contacts the blade housing.

10. The razor assembly of claim 1, wherein:

the blade housing comprises one or more guide rails;

the connector comprises at least one guided shaft member movable along the corresponding one or more guide rails between the first rest position and the first position spaced from the first rest position in the first shaving direction.

11. The razor assembly of claim 10, wherein at least a portion of a path of the at least one guided shaft member moving along the one or more guide rails comprises a curved portion.

12. The razor assembly of claim 11, wherein:

the path of the at least one guided shaft member moving along the one or more guide rails from the first rest position to the first position comprises a curve that is curved away from a cutting surface of the blade housing; and a first distance between the cutting surface of the blade housing and the at least one guided shaft member in the first position is greater than a second distance between the cutting surface of the blade housing and the at least one guided shaft member in the first rest position.

* * * * *